United States Patent [19]

De Napoli

[11] 4,122,944

[45] Oct. 31, 1978

[54] TOOL BOX

[76] Inventor: Vincent De Napoli, 1821 NW. 108 Ave., Pembroke Pines, Fla. 33026

[21] Appl. No.: 844,589

[22] Filed: Oct. 25, 1977

[51] Int. Cl.[2] ..... B65D 43/12

[52] U.S. Cl. ..... 206/349; 217/62; 220/345; 312/DIG. 33

[58] Field of Search ..... 206/349, 45.2; 220/345, 220/350, DIG. 25; 312/DIG. 33; 217/62, 19; 229/9, 19

[56] References Cited

U.S. PATENT DOCUMENTS

| | | | |
|---|---|---|---|
| 1,663,103 | 3/1928 | Thompson | 220/345 |
| 1,867,080 | 7/1932 | Kraft | 220/345 |
| 2,107,997 | 2/1938 | Horsley | 220/345 |
| 2,278,850 | 4/1942 | Hammond | 217/62 |
| 2,532,083 | 11/1950 | Brenner | 220/345 |
| 3,003,840 | 10/1961 | Katzin | 206/45.2 |

*Primary Examiner*—William T. Dixson, Jr.

[57] ABSTRACT

An improved tool box having a lid slidingly arranged in covering relation of the main opening and a slide track beneath the main tool box so that, the lid may be slidably removed to open the box and the lid stored beneath the box in an out-of-the-way position.

4 Claims, 4 Drawing Figures

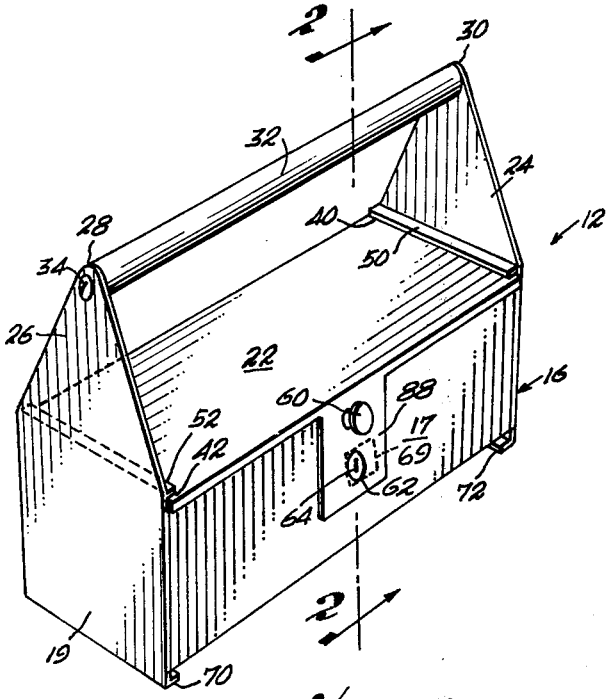
Fig. 1
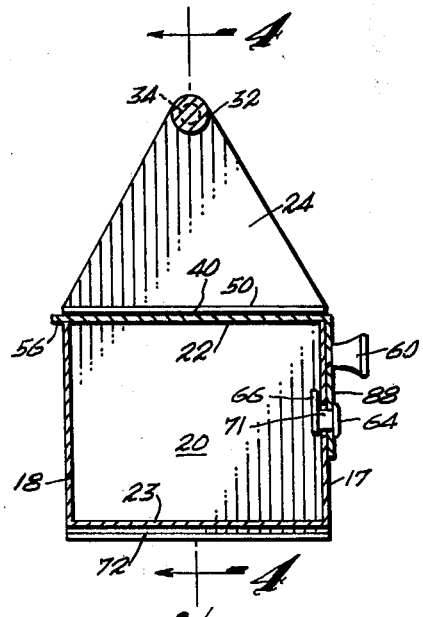
Fig. 2
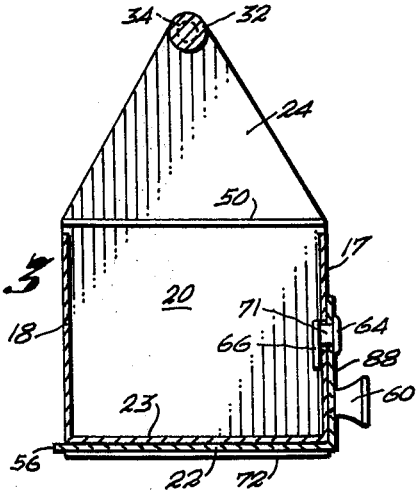
Fig. 3
Fig. 4
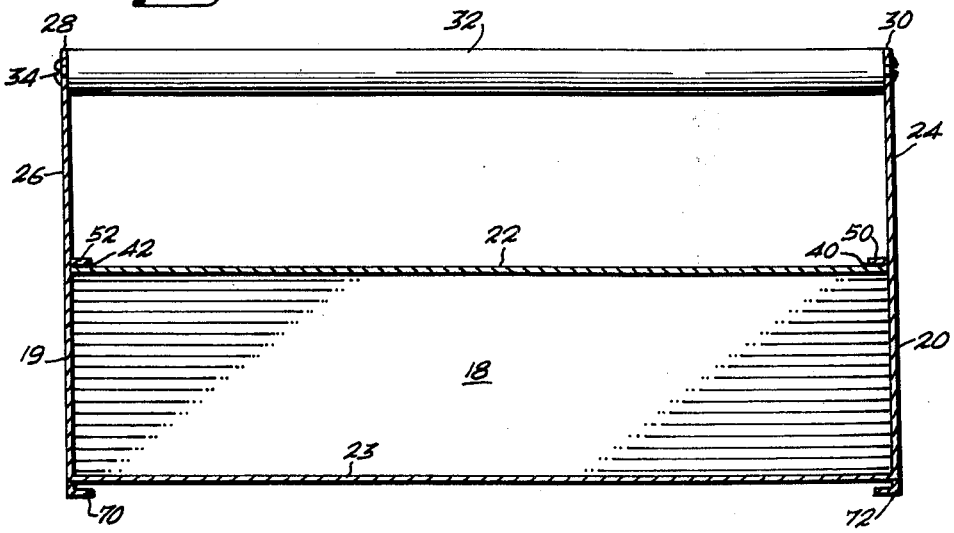

TOOL BOX

FIELD OF THE INVENTION

This invention relates to tool boxes and, more particularly, to an improved tool box with a removable lid.

BACKGROUND OF THE INVENTION

In the past there have been numerous types of tool boxes. This invention is of a tool box; however, it includes a lid which is removable and a storage structure so that the lid may be conveniently stored in an out-of-the-way convenient location when not in use.

Generally speaking, as is perhaps well known, workmen open their tool boxes for convenient removal and replacement of tools; and, when not in use, they prefer to lock their tool boxes because tools are very expensive. This means that a lid must often be removed for convenient access into a full open tool box but there is the problem of storing the lid. Additionally, the lid is often lost or, sometimes, stolen and used for another purpose at a job site.

This invention is of a tool box with a lid which is held in position in covering relation of a tool box but which can be slidably removed and stored in a slide track beneath the tool box.

OBJECTS OF THE INVENTION

It is, accordingly, an object of this invention to provide an improved tool box which includes a lid which may be locked in position when the tool box is not in use, as for example, when a workman goes to lunch, and which when the tool box is being used, may be slidably removed and stored in a convenient out-of-the-way location in a slide-in location beneath the tool box.

In accordance with these and other objects which will become apparent hereinafter, the instant invention will now be described with reference to the accompanying drawings, in which:

DESCRIPTION OF THE DRAWINGS

FIG. 1 is a perspective view of the instant invention;

FIG. 2 is a view in cross section taken on the plane indicated by the line 2—2 of FIG. 1 and looking in the direction of the arrows;

FIG. 3 is a view in cross section similar to FIG. 2 and taken on the same plane and illustrating the invention in a different attitude of use;

FIG. 4 is a view in cross section taken on the plane indicated by the line 4—4 of FIG. 2 and looking in the direction of the arrows.

DESCRIPTION OF THE PREFERRED EMBODIMENT

Referring to the drawings wherein like reference characters designate like or corresponding parts throughout the several views and referring particularly to FIG. 1, the numeral 12 generally designates the tool box. The tool box includes a frame generally designated by the numeral 16, opposed end walls 19 and 20 and opposed front and rear walls 17 and 18 which span the end walls. A roof 22 is provided in spanning relation of the end walls and a floor 23, see FIG. 2. The ends are joined together to form the enclosed tool compartment. The end walls 19 and 20 each include an upwardly extending portion, which are designated by the numerals 24 and 26 and which are generally triangular form converging to apexes as at 28 and 30. The apexes are spanned by a handle 32 which is fixed through a hole and held in position by means of screws, such as 34. With respect to the end walls, it is seen that at about the zone of juncture between the upwardly extending portions 24 and 26, there is a guide track 40 and 42 provided which are of channel form and open inwardly in confronting relation, see FIG. 1 at the numerals designated 40 and 42. The marginal edge of the roof member 22 is slidably received within the channels and is sized to span the space and to nest beneath the upper flanges 50 and 52. The upper roof also includes a downwardly extending portion generally designated by the numeral 88 which is located in the center of the top and which overlays the front surface 17, see FIG. 1 and FIG. 2. It will be seen that there is a hole 62 provided at a location such that it registers with a hole in the front face 17, shown in dotted lines and designeated by the numeral 69. It will be seen that this hole is elongated. A lock comprising a cylinder 71 is fixed in hole 62 through the downwardly extending portion and it includes a latch 66 which is operable by insertion of a key into the hole 64 to turn it into the upward position shown in FIG. 2 and in which position the box is locked. When the box is unlocked, by sliding outwardly, using the handle 60, the edges 50 and 52 slide outwardly until the edge 56 is clear of the tracks of the sidewalls and, if desired, the lid may be rotated through 180° and inserted with the leading edge 56 being received in grooves 70 and 72 which are provided at the base of the end walls and, when in position, the same may be locked by turning the lock, locking it in the locked position so that the plate 88 overlays the front face. It will be seen that the centerline of the hole of the lock is arranged on the depending portion 88 of the roof at a location such that it is midway when the roof is either in the top track or the bottom track and registers with the hole and may be utilized to lock the box in an open position or an unopen position, which is a very convenient thing to a workman.

What is claimed is:

1. A tool box comprising:

a pair of opposed end wall portions of common size in confronting relation, each of said end portions having an inner face and an outer face and a lower edge, said end wall portions each having parallel side edges extending vertically upwardly from said lower edge a common distance to a first predetermined height and said edges extending in converging relation to one another above said predetermined height to an apex, each of said inner faces having an upper guide channel extending outwardly in perpendicular relation of said faces at said predetermined height, and extending across said inner faces between the respective side edges, each of said inner faces having a lower inturned foot portion at said lower edge, said box having a floor portion spanning the side wall portions in spaced relation above said lower inturned foot portion defining a lower guide means between the floor and the foot on each of said end wall portions, said box including a front panel portion and a rear panel portion, each of said panel portions having an upper panel edge and said upper panel edges being in a common plane at a second predetermined height slightly less than said first predetermined height, defining between said upper panel edges, said upper guide channel and said upper panel edges comprising an upper guide means between said upper panel edges and said upper guide channels, said box including a lid, and said lid being sized to span the end wall portions and panel portions and being of a thickness sized for sliding receipt in said upper and lower guide channel means, and said lid including a downwardly extending tab normally overlaying said front panel, said tab including handle means, and said lid being adapted to be slidably removed from said upper guide means by said handle and rotated through 180° and reinserted into said lower guide means for storage, and said box including handle means spanning the apexes of said end wall portions for carrying said box.

2. The device as set forth in claim 1 wherein said tab and said front panel include a hole therethrough and said hole being one-half the distance between said guide means and said tab overlaying said hole with the hole in said tab being aligned with said hole in said front panel and lock means in said holes for selectively locking said lid in said upper guide means or said lower guide means.

3. The device as set forth in claim 1 wherein handle means are provided on said tab for manipulating said lid.

4. The device as set forth in claim 2 wherein handle means are provided on said tab for manipulating said lid.

* * * * *